United States Patent [19]

Boiten et al.

[11] 4,259,781

[45] Apr. 7, 1981

[54] SHAVING APPARATUS

[75] Inventors: Ebbe Boiten; Gerrit J. Groothuis; Jochem J. de Vries, all of Drachten, Netherlands

[73] Assignee: U.S. Philips Corporation, New York, N.Y.

[21] Appl. No.: 17,768

[22] Filed: Mar. 5, 1979

[30] Foreign Application Priority Data

Mar. 15, 1978 [NL] Netherlands ..... 7802795

[51] Int. Cl.[3] ..... B26B 19/14

[52] U.S. Cl. ..... 30/43.6; 30/346.51

[58] Field of Search ..... 30/43.6, 346.51, 43.92; 76/104 R

[56] References Cited

U.S. PATENT DOCUMENTS

| | | | |
|---|---|---|---|
| 2,677,884 | 5/1954 | Richard | 30/43.6 |
| 3,088,205 | 5/1963 | Ellis | 30/43.6 |
| 3,962,784 | 6/1976 | Tietjens | 30/346.51 |
| 4,151,645 | 5/1979 | Tietjens | 30/346.51 X |

*Primary Examiner*—Gary L. Smith

*Attorney, Agent, or Firm*—T. A. Briody; W. J. Streeter; R. E. Schneider

[57] ABSTRACT

A shaving apparatus has a circular shear plate provided with hair-entry apertures and a cutting unit associated with and rotatable relative to the shear plate. The cutting unit comprises a cutting member having a circular central body provided with circumferentially arranged cutters and lead cutters respectively associated with and movable relative to the cutters. Each lead cutter is secured to the central body of the cutting member by a resilient connecting arm, the inner end portion of which extends substantially radially with respect to the cutting unit axis and undergoes torsion-loading by reason of the movement of the lead cutter away from the shear plate, the lead cutter being connected eccentrically to such inner end portion. The torsion-loading is elastically opposed in each instance.

7 Claims, 7 Drawing Figures

SHAVING APPARATUS

This invention relates to a shaving apparatus having a circular shear plate provided with hair-enetry apertures and a cutting unit associated with and rotatable relative to the shear plate, which cutting unit comprises a cutting member having a circular central body which is provided with cutters on its circumference and which cutting member is equipped with lead cutters which are movable relative to the cutters, each lead cutter being connected to the central body of the cutting member by means of a connecting arm.

Such a shaving apparatus is for example known from U.S. Pat. No. 3,962,784. The connecting arms of this apparatus take the form of strips of a sheet material which are integral with the lead cutters and with a central ring which is connected to the central body of the cutting member. The connecting arm engages with the cutter, so that the arm can be bent only in a direction away from the cutter. Thus, the known construction does not allow the lead cutter to engage the shear plate under pre-tension independently of the associated cutter. When the arm bends the lead cutter may be lifted off the associated cutter, which has an adverse effect on the shaving action. Moreover, shaving particles are likely to collect between the connecting arm and the cutter.

The present invention, whose object it is to eliminate said drawbacks, leads to a construction which is characterized in that the connecting arm comprises at least one torsion-elastic portion, which is loaded in torsion as a result of the movement of the lead cutter relative to the associated cutter.

Generally, the torsion-elastic portion will not take the form of a strip of a sheet material and may be interposed between two cutters, so that said goal is already achieved.

An embodiment which is highly compact is characterized in that the torsion-elastic portion is supported so as to prevent flexure.

A preferred embodiment is characterized in that the torsion-elastic portion takes the form of a length of wire of round cross-section.

A related special embodiment is characterized in that on one end the length of wire is provided with an arm which extends substantially in a radial direction relative to the length of wire and which engages with a resilient element which is secured to the central body of the cutting member.

A different embodiment is characterized in that on one end the length of wire is provided with an arm which extends substantially in a radial direction relative to the length of wire and which adjoins a similar arm of another lead cutter.

An embodiment which can be manufactured simply is characterized in that both the lead cutter and the connecting arm are integrally manufactured from a length of wire.

However, it is also possible to realize an embodiment in which the lead cutter and the connecting arm are separate components, which are manufactured from different materials.

The invention will now be described with reference to the accompanying drawings, in which.

Figure 1:
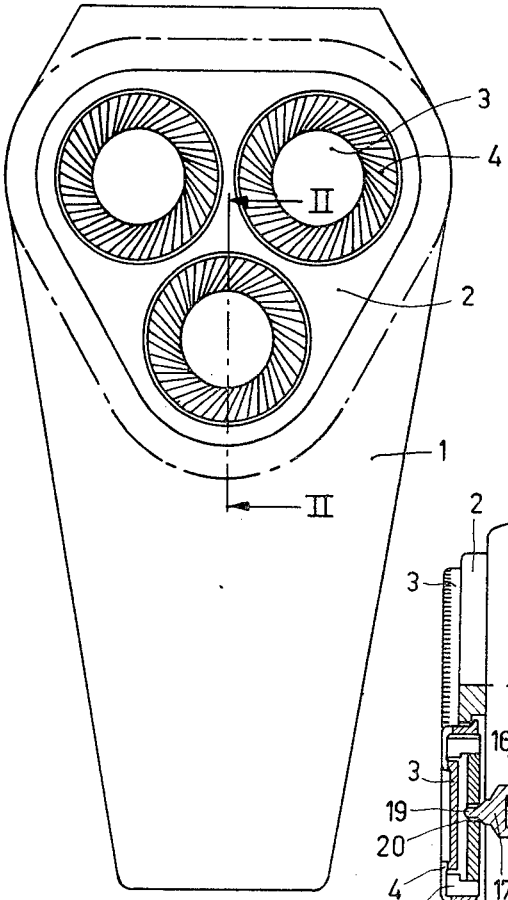
FIG. 1 is an elevation of a shaving apparatus having three shear plates.
Figure 2:
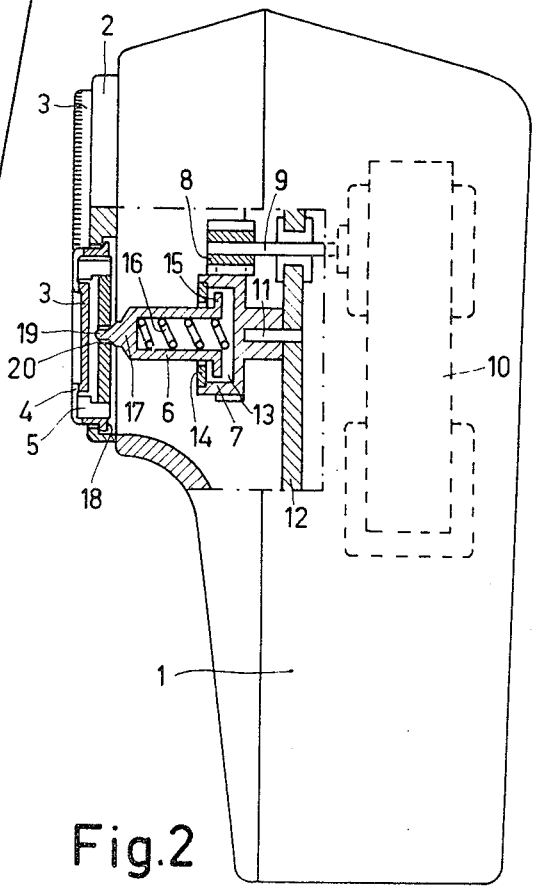
FIG. 2 shows the shaving apparatus of FIG. 1 in side view and partly in a cross-section taken on the line II—II in FIG. 1.

The shaving apparatus in accordance with FIGS. 1 and 2 comprises a housing 1, of which a part takes the form of a shear plate holder 2 for three shear plates 3. The shear plates 3 are formed with hair-entry apertures 4.

As shown in the partial cross-section of FIG. 2 a cutting unit 5 is located on the inner side of a shear plate 3. This cutting unit 5, which for the sake of clarity is only shown schematically in FIG. 2, comprises a cutting member and cutters and is shown in detail on an enlarged scale in FIG. 3.

The cutting unit 5 is coupled to the electric motor 10 by means of the hollow spindle 6 (FIG. 2), the gear wheels 7 and 8, and the spindle 9, so that the cutting unit is rotatable relative to the associated shear plate 3. The gear wheel 7 is rotatably journalled on a pin 11 which is mounted in a mounting plate 12. The gear wheel 7 has a recess 13 which is closed by a cover plate 14. This recess receives the flange 15 at the end of the hollow spindle 6. By giving the flange 15 a non-round, for example square, shape and by shaping the recess 13 accordingly, a coupling is obtained for the transmission of the rotary movement of the gear wheel 7 to the spindle 6. The spring 16, which for its greater part is situated in the hollow spindle 6 and which is tensioned between the hollow spindle 6 and the gear wheel 7, exerts a force on the spindle 6 in the direction of the cutting unit 5. Since the cylindrical portion 17 of the spindle 6 bears against the cutting unit 5, this force is exerted on the cutting unit and via the cutting unit on the shear plate 3, so that the shear plate is urged against the shear plate holder 2 by means of the flanged edge 18. As a result of external forces, as may for example occur during use of the shaving apparatus, the shear plate 3 together with the cutting unit 5 and the spindle 6 can be pressed inwards against the action of the spring 16.

The coupling for the transmission of the rotary movement between the spindle 6 and the cutting unit 5 is obtained in that the spindle 6 is provided with an end 19 of rectangular cross-section. This end 19 engages with a corresponding rectangular coupling aperture 20 in the cutting unit 5.

The coupling to the electric motor 10 is identical for the three cutting units of the apparatus of FIGS. 1 and 2, the three gear wheels 7 being in engagement with the single centrally disposed gear wheel 8 on the motor spindle 9.

The cutting unit 5 (FIG. 3) comprises a cutting member 21 which is substantially constituted by a central body 22 which is provided with cutters 23 on its circumference and in which moreover the coupling aperture 20 is formed.

Each cutter 23 is provided with a lead cutter 24, which is secured to the central body 22 of the cutting member by means of a connecting arm 25. The lead cutter 24 and connecting arm 25 are integral and are manufactured from a resilient wire material of for example round cross-section.

The connecting arm 25 is bent to such a shape that it has three distinct portions 26, 27 and 28. The end 29 of the portion 28 is retained in a cam 30 of the central body 22. If the central body 22 is a metal or plastic casting, the ends 29 can be secured by placing them in the mould. In order to ensure a proper anchorage the ends 29 may be given a non-round, for example flattened, shape. The lead cutter 24 at the end of portion 26 is of rectangular shape and is also obtained by flattening the wire material.

For greater freedom in respect of the choice of materials and the shape and dimensions of the several parts, the lead cutter and the connecting arm may also be constituted by separate components which have been manufactured from different materials and which are for example secured to each other by spot-welding.

Figure 4:
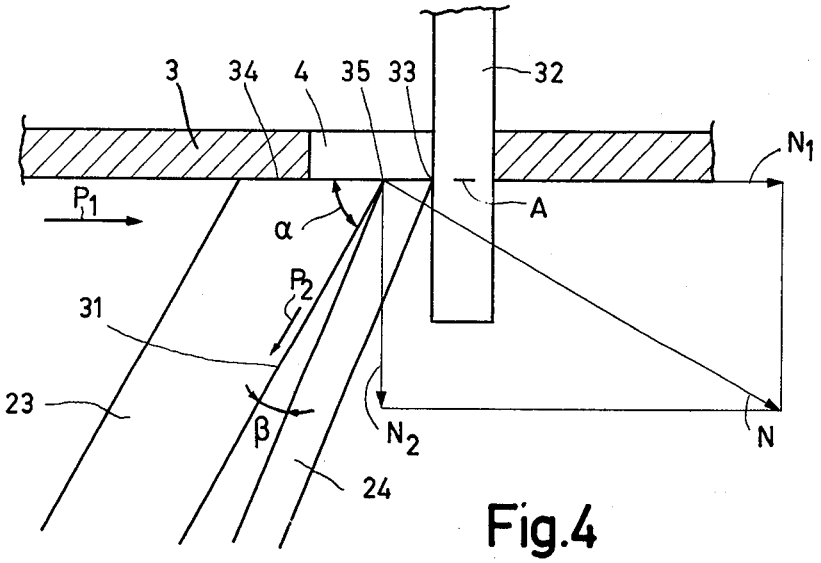
FIGS. 4 and 5 illustrate on an enlarged scale the operation of a lead cutter.

The operation of the apparatus will be explained with reference to FIGS. 4 and 5 which show a part of a cutter and a lead cutter in side view and which also show a part of the shear plate. The lead cutter 24 engages with the guide wall 31 of the associated cutter 23. When a hair 32 is caught in a hair-entry aperture 4 this hair will soon come into contact with the sharp edge 33 of the lead cutter 24 at the location A owing to the rotary movement of the cutter 23 and the lead cutter 24 (FIG. 4). The sharp edge 33 will then slightly penetrate the hair 32. The reaction force which is exerted by the hair on the lead cutter 24 will be directed oppositely to the direction of movement $P_1$. This force is compensated for by the component $N_1$ of the normal force N which is exerted on the lead cutter 24 by the guide wall 31 of the cutter 23. For simplicity the slight frictional forces between the lead cutter 24 and the cutter 23 have been neglected. The component $N_2$ of the normal force N will cause the lead cutter 24 to slide along the guide wall 31 in the direction $P_2$ relative to the cutter 23. The angle $\alpha$ between the guide wall 31 and the wall 34 of the cutter 23, which engages with the shear plate 3, should be smaller than 90°.

Figure 5:
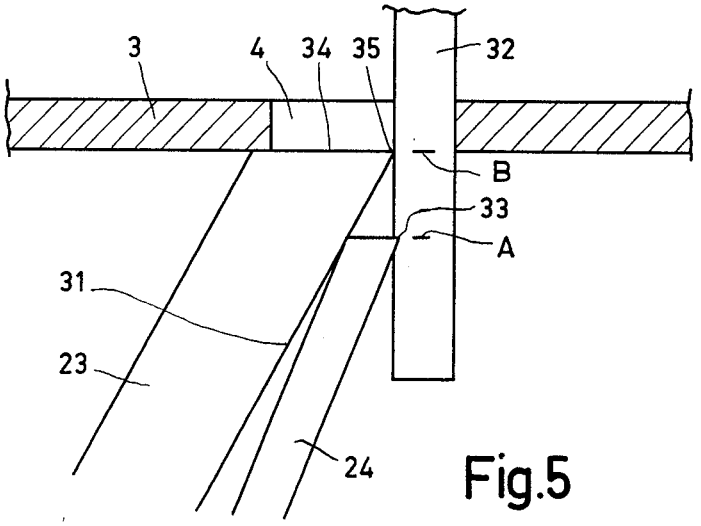

Owing to inter alia the natural elasticity of the skin the hair 32 will be moved along by the lead cutter 24 until the cutting edge 35 of the cutter 23 has reached the hair at the location B (FIG. 5). Subsequently, the hair will be cut by co-operation of the shear plate 3 and the cutter 23. Thus, a part of the hair 32 is cut which is longer than the part that would be cut without a lead cutter by a length equal to the distance between A and B, so that a better shaving result is obtained.

The lead cutter 24 may extend parallel to the cutter 23 and engage completely with the guide wall 31 or make an angle $\beta$ with the cutter, as is shown in FIG. 4.

Figure 3:
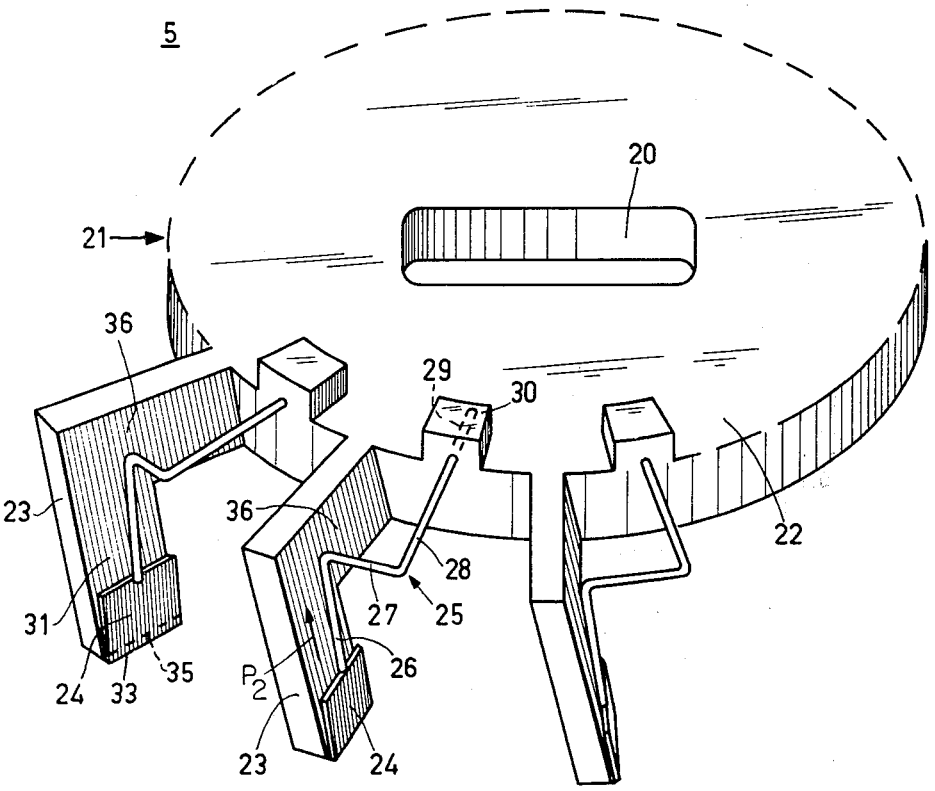
FIG. 3 shows on an enlarged scale the cutting member with lead cutters in perspective.

The lead cutter is movable relative to the cutter owing to the elastic properties of the connecting arm 25 (FIG. 3). During the displacement in the direction $P_2$ the portions 26, 27 and 28 will be subject to flexure and the portion 28 moreover to torsion. The embodiment shown has the advantage that during the movement the sharp edge 33 remains parallel to the cutting edge 35, which promotes the action of the lead cutter. The torsion-elastic portion 28 may be situated at some distance from the arm 36 by which the cutter 23 is secured to the central body so that the likelihood of shaving particles collecting between the portion 28 and the arm 36 is reduced.

Alternatively, the embodiment may be such that the movability of the lead cutter relative to the cutter mainly results from the elastic properties of the torsion-elastic portion and that the other portions of the connecting arm have a substantially higher rigidity. In any case, the use of a torsion-elastic portion enables the known advantages of a torsion bar to be obtained, such as simple manufacture and a homogeneous stress distribution in the material of the bar. In this respect wire of round cross-section is eminently suitable as a material for the torsion-elastic portion and, if desired, also for the rest of the connecting arm, but it is also possible to use a sheet material or a rod or wire material of a different cross-section.

Figure 6:
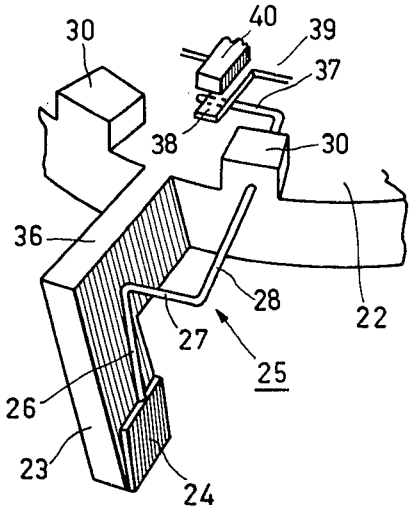
FIGS. 6 and 7 show variants of the embodiment of FIG. 3.

In the embodiment of FIG. 6 the portion 28 which during the movement of the lead cutter 24 relative to the cutter 23 is loaded in torsion is rotatably journalled in the cam 30. At the end the portion 28 is provided with a right-angled part 37 which engages with a resilient arm 38. The resilient arm 38 for example constitutes a part of a plate-shaped body 39 which is secured to the central body 22. In this way it is still possible to obtain a sufficiently large elastic deflection if the connecting arm 25 has too large a diameter and thus too high a rigidity. This diameter cannot be selected arbitrarily small if the lead cutter 24 at the end of the connecting arm is formed by flattening the wire material.

The deflection of the resilient arm may for example be limited by a stop 40, as is schematically indicated in FIG. 6. This stop 40 is also secured to the central body 22. The movability of the lead cutter 24, which first of all depends on the elastic properties of the connecting arm 25 and the resilient arm 38, then depends exclusively on the connecting arm alone if the resilient arm has reached the stop 40.

Figure 7:
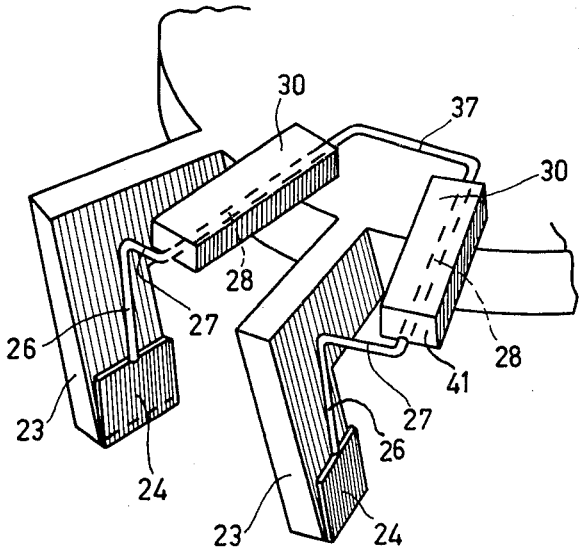

The embodiment of FIG. 7 can be derived from that of FIG. 6 by interconnecting two portions 37 of two lead cutters. The total spring length is then doubled and the resilient arm 38 may be dispensed with. The cam 30 in which the torsion-elastic portion 28 is rotatably journalled is extended by a stop 41 which supports the torsion-elastic portion so as to prevent flexure. Flexure of the portion 28 thus being prevented, said portion will occupy little room. Obviously, such a support is also possible in the respective embodiments in accordance with FIGS. 3 and 6.

What is claimed is:

1. A shaving apparatus having a circular shear plate provided with hair-entry apertures and a cutting unit associated with and rotatable relative to the shear plate; said cutting unit comprising a cutting member having a circular central body, cutters extending from the circumference of said central body toward the shear plate, lead cutters respectively associated with and movable relative to the cutters away from and toward the shear plate, resilient connecting arms respectively securing the lead cutters to the central body of the cutting member, the inner end portion of each connecting arm extending substantially radially with respect to the rotational axis of the cutting unit and undergoing torsion-loading as a result of movement of its associated lead cutter away from the shear plate, said associated lead cutter being connected eccentrically to said inner end portion, and means for elastically opposing the torsion-loading on the inner end portion of each connecting arm.

2. A shaving apparatus according to claim 1, which includes means to support the inner end portion of each connecting arm to prevent flexure thereof.

3. A shaving apparatus according to claim 1 or 2, in which the inner end portion of each connecting arm is formed of round cross-section wire.

4. A shaving apparatus according to claim 1, in which the inner end portion of each connecting arm is provided with an extension substantially at a right angle thereto, and the elastically opposing means is secured to the central body of the cutting member for engagement with said extension.

5. A shaving apparatus according to claim 1, in which the inner end portion of each connecting arm is joined remotely from the rotational axis of the cutting unit by a second portion substantially at a right angle thereto, the associated lead cutter being connected to the outer end of said second portion.

6. A shaving apparatus according to claim 1, in which each lead cutter and its connecting arm are integrally formed from a length of wire.

7. A shaving apparatus according to claim 1, in which each lead cutter and its connecting arm are formed from different materials.

* * * * *